US006131920A

United States Patent [19]

Roman et al.

[11] Patent Number: 6,131,920

[45] Date of Patent: Oct. 17, 2000

[54] BRAKING CONTROL DEVICE, PARTICULARLY FOR SKATES

[75] Inventors: Maurizio Roman, Noale; Alessandro Pozzobon, Paderno Di Ponzano Veneto; Roberto Gorza, Feltre, all of Italy

[73] Assignee: Nordica S.p.A., Trevignano, Italy

[21] Appl. No.: 08/882,543

[22] Filed: Jun. 25, 1997

[30] Foreign Application Priority Data

Jul. 1, 1996 [IT] Italy ..... TV96A0085

[51] Int. Cl.[7] ..... A63C 17/14; A63C 17/06

[52] U.S. Cl. ..... 280/11.2; 280/11.22

[58] Field of Search ..... 280/11.2, 11.22

[56] References Cited

U.S. PATENT DOCUMENTS

| | | | |
|---|---|---|---|
| 3,682,280 | 8/1972 | Fowler | 188/265 |
| 4,545,322 | 10/1985 | Yang | 188/67 |
| 5,320,367 | 6/1994 | Landis | 280/11.2 |
| 5,437,466 | 8/1995 | Meibock | 280/11.2 |
| 5,505,469 | 4/1996 | Zorzi et al. | 280/11.2 |
| 5,630,595 | 5/1997 | Perner | 280/11.2 |
| 5,630,597 | 5/1997 | Klukos | 280/11.2 |
| 5,752,707 | 5/1998 | Cottel | 280/11.2 |
| 5,785,326 | 7/1998 | Chang | 280/11.2 |
| 5,794,950 | 8/1998 | Svensson | 280/11.2 |
| 5,918,888 | 7/1999 | Pellegrini, Jr. et al. | 280/11.2 |

FOREIGN PATENT DOCUMENTS

| | | |
|---|---|---|
| 1 307 77 | 4/1996 | Austria . |
| 9 517 232 | 6/1995 | WIPO . |

*Primary Examiner*—Lanna Mai
*Assistant Examiner*—Andrew J. Ririe
*Attorney, Agent, or Firm*—Guido Modiano; Albert Josif

[57] ABSTRACT

A braking control device for skates including a shoe having a toe portion at a forward location and a heel portion at a rearward location, and a pivoting quarter, and the shoe being connected with a chassis having a plurality of wheels at least one of which interacts with a brake device, The braking control device has structure allowing to transfer a braking force to the at least one wheel up to a presettable value, which is preferably close to the value required to lock the at least one wheel and beyond which an excess force is substantially not transferred to the at least one wheel. The brake device includes: a braking block pivoted to the chassis; and a bar connected at a first end to the quarter and slidingly engaged in a seat of a rearward protrusion of the braking block, and the bar has at a second end thereof a T-shaped tip forming a head abutting against the protrusion of the braking block.

7 Claims, 10 Drawing Sheets

Fig. 10a
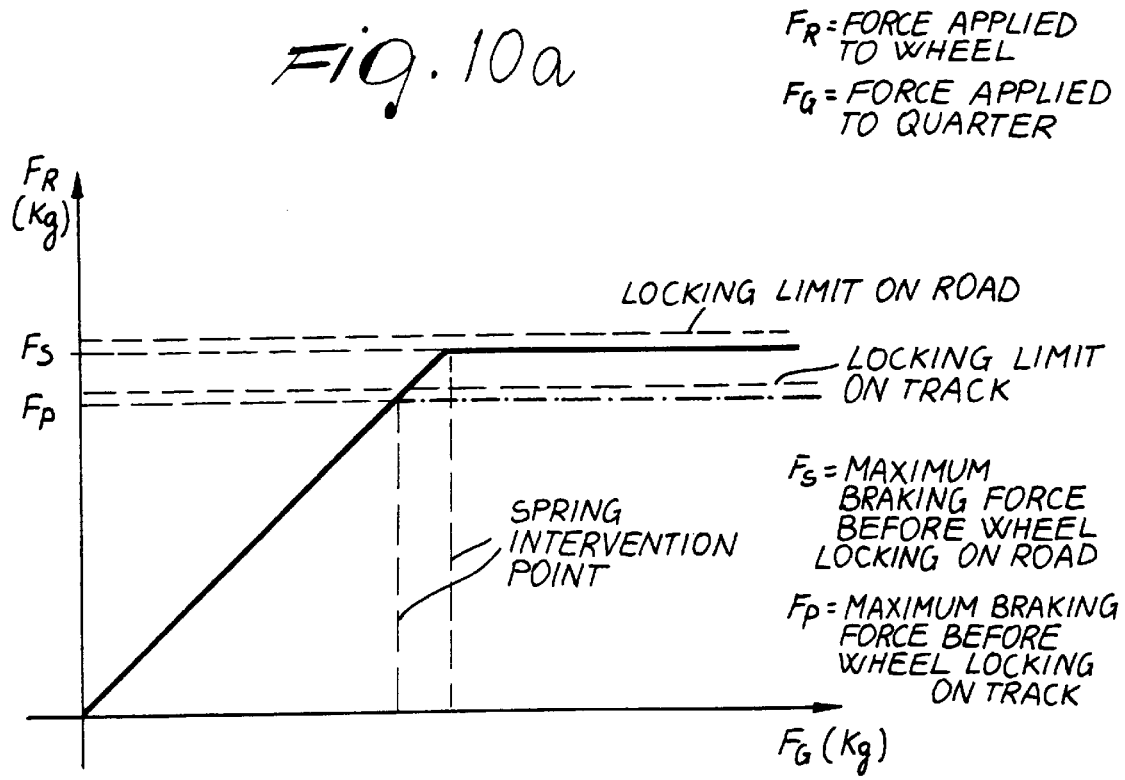
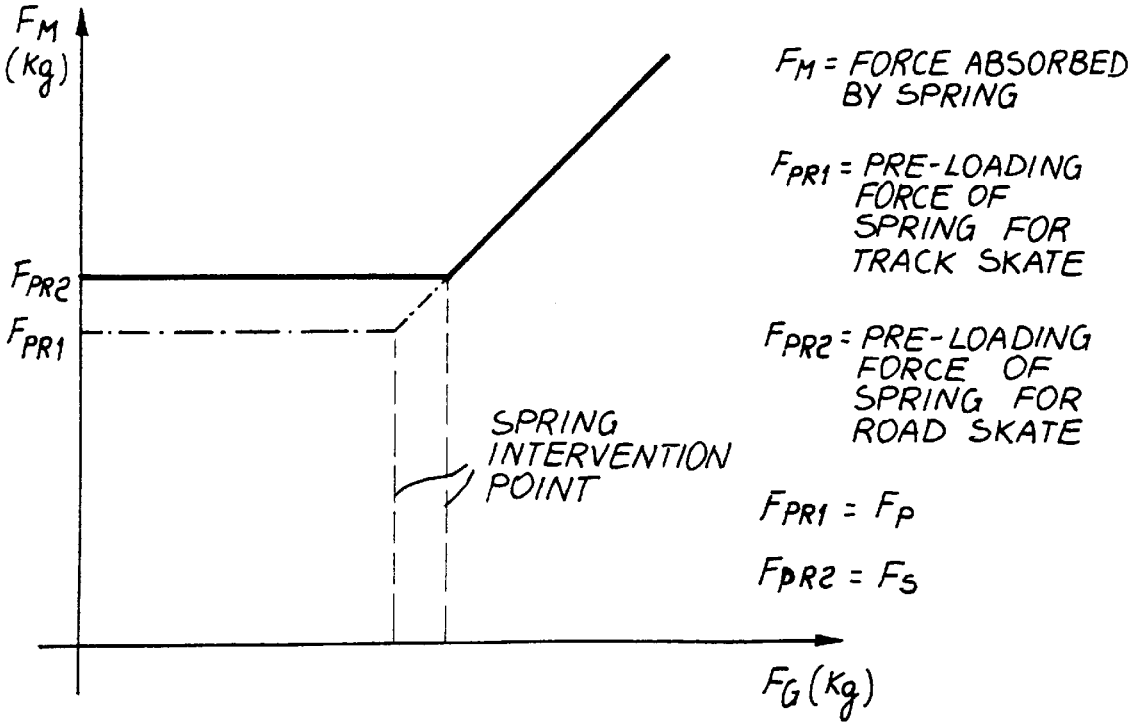
Fig. 10b

BRAKING CONTROL DEVICE, PARTICULARLY FOR SKATES

BACKGROUND OF THE INVENTION

The present invention relates to a braking control device particularly usable for skates.

In conventional roller skates, whether constituted by a shoe associated with a support for two pairs of wheels arranged parallel to each other or by a shoe associated with a supporting frame for two or more in-line wheels, there is currently the problem of braking the wheels in order to adjust the skate speed.

It is known to use adapted pads or blocks, usually made of rubber, which are arranged at the toe or heel region of the shoe; when the user tilts the shoe forward or backward, the free end of the pads or blocks interacts with the ground and braking is thus achieved.

However, these conventional devices have the drawback that it is necessary to tilt the shoe, lifting the wheels off the ground, and this can entail loss of balance, especially for beginners of this sports activity.

U.S. Pat. No. 5,374,070, in the name of this same Applicant, discloses a braking device, particularly for skates comprising a shoe composed of a quarter articulated to a shell in turn associated with a supporting frame for two or more in-line wheels, having the characteristic of comprising one or more rod members associated, at one end, laterally to the quarter and simultaneously rotatably associated with the quarter and/or with the shell.

The rod members have, at their other end, means for connection to the pivot of one of the wheels, these means being slideable with respect to the frame towards the adjacent wheels, so as to allow braking at the wheels when the quarter is moved backward.

U.S. Pat. No. 5,505,469 discloses a braking device compring a traction element, such as a rod or cable, connecting the quarter to a braking element that interacts with the wheels.

In this case, too, when the quarter is rotated forward or backward, the braking element is actuated, for example by means of the rod or cable, and interacts for example directly with the rolling surface of the wheels.

The above devices are similar in that the action of the braking device applies directly at the wheels: this can entail drawbacks, because the intensity of the force applied by the user to the braking elements to achieve effective braking is determined by the inclination the user gives to the quarter and depends on many factors, such as the roughness of the ground, the weight of the user and the kind of wheel.

Accordingly, in the above devices the wheel or wheels often lock upon braking and this entails uneven wear of the surface thereof.

The friction occurring for example between the wheel and any block interacting therewith completely locks the rotation of the wheel, and the friction between the wheels and the ground is converted from rolling friction to sliding friction; since the terrain over which the wheel travels is usually highly abrasive and rough, locking during braking causes localized wear of the wheel in the region of contact, thus "flattening" the wheel and forming substantially flat regions along the outer circumference of the wheel which, in addition to causing very quick and uneven wear of the wheel, compromise the stability and balance of the skate and of the user.

SUMMARY OF THE INVENTION

An aim of the present invention is to solve the described problems, eliminating the drawbacks of the cited prior art by providing a device having an optimal braking action and protecting the wheels against any "flattening" caused by the scraping of the wheels against the ground in case of wheel locking.

A further object is to provide a device allowing the user to achieve optimum braking regardless of the force applied by the user which may be even several times greater than the necessary force at braking devices acting on the wheels or wheel hubs.

A further object is to provide a device which is structurally simple and activation whereof is independent of specific and direct actions performed by the user.

A further object is to provide a device which can be easily activated by the user.

A further object is to provide a device which is reliable and safe in use and has low manufacturing costs.

This aim, these objects, and others which will become apparent hereinafter are achieved by a braking control device, particularly for skates comprising a shoe associated, in a downward region, with a chassis whereto a plurality of wheels are freely pivoted, one or more of said wheels interacting with elements which brake their motion, characterized in that said device comprises means allowing to transfer energy to said braking elements up to a presettable value, which is preferably close to the one required to lock said wheels and beyond which the excess energy is dissipated.

BRIEF DESCRIPTION OF THE DRAWINGS

Further characteristics and advantages of the present invention will become apparent from the following detailed description of some particular but not exclusive embodiments thereof, illustrated only by way of non-limitative example in the accompanying drawings, wherein:

FIG. 10*a* is a chart plotting the force applied to the wheel; and

FIG. 10*b* is a chart plotting the force absorbed by the spring as a function of the force applied to the quarter.

DESCRIPTION OF THE PREFERRED EMBODIMENTS

Figure 1:
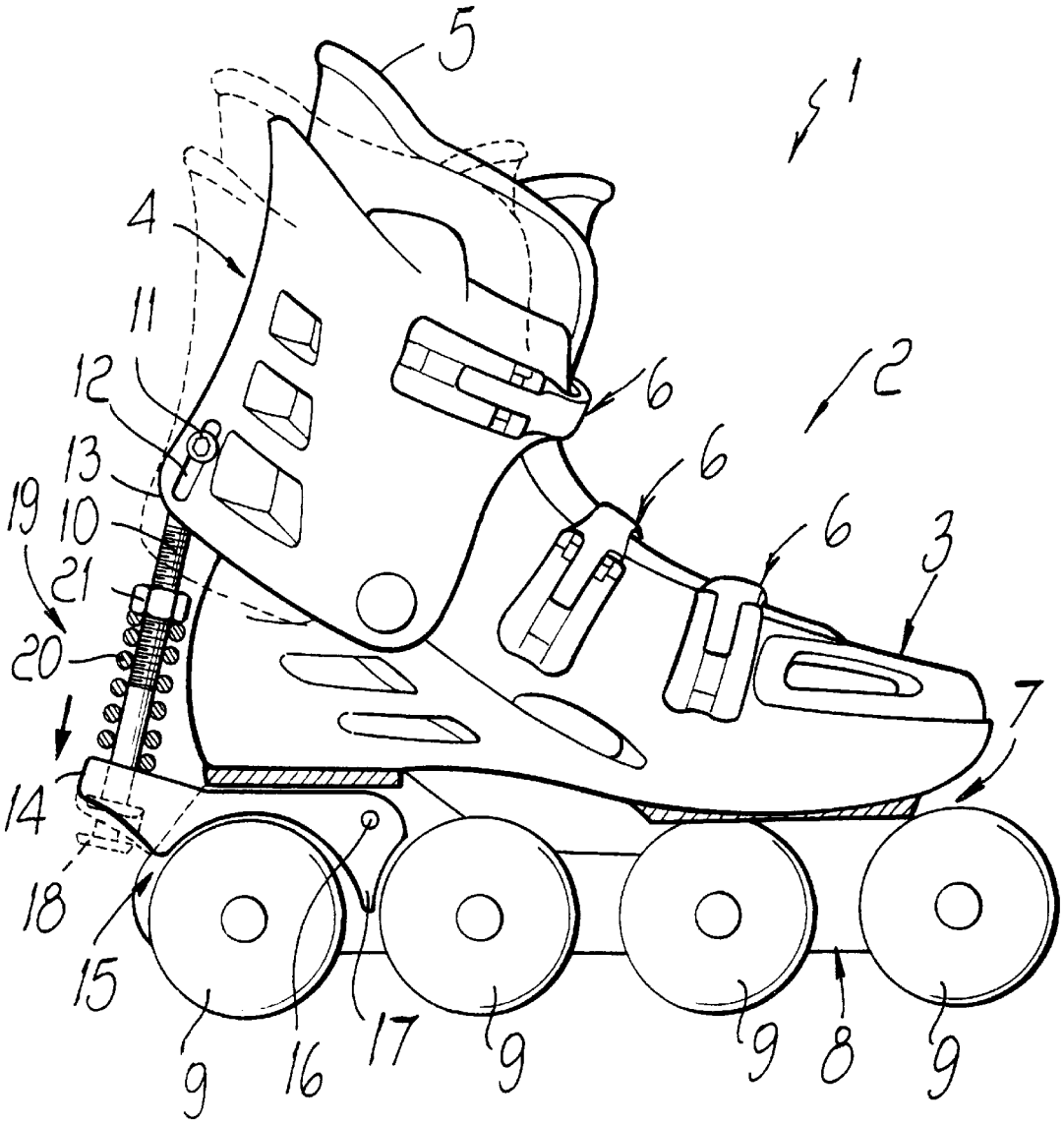
FIG. 1 is a side view of a first embodiment of the invention.

With reference to the above figures, the reference numeral 1 designates a skate comprising a shoe 2 composed of a shell 3, wherewith at least one quarter 4 is rotatably associated; a soft innerboot 5 is arranged inside said shell and said quarter, and said shell and said quarter can be fastened to each other by means of adapted conventional closure devices, such as for example adapted levers 6.

The shoe 2 is associated, in a downward region, with an adapted chassis 7 the transverse cross-section whereof is preferably substantially C-shaped; a plurality of wheels 9 are transversely and freely pivoted between the wings 8 of said chassis and are thus mutually in-line.

The skate 1 also comprises adapted braking means interacting with one or more of the wheels 9; the brake means are for example of the type constituted by a threaded bar 10 connected, at one end and by means of an adapted screw 11, at one or more slots 12 formed approximately longitudinally with respect to the quarter 4 proximate to its lower perimetric edge 13, in the region lying approximately above the user's heel.

The bar 10 is slidingly associated at an adapted seat formed on a first projection 14 protruding to the rear of a block 15 which is arranged between the wings 8 of the chassis 7 and lies above the last wheel 9. The block is pivoted at the opposite end, by means of an adapted pivot 16, between the wings 8 of the chassis 7.

Advantageously, the block 15 has, proximate to said pivot 16, a second projection 17 facing the last-but-one wheel 9, so that activation of the block causes interaction of the block with two wheels.

The tip of the bar 10 is T-shaped, forming a head 18 which abuts against the first projection 14 when the quarter is rotated clockwise.

The braking control device, generally designated by the reference numeral 19, is also constituted by at least one flexible element, such as a spring 20 arranged coaxially to the bar 10 and interposed between the projection 14 and a nut 21 which is associated with said bar 10.

The nut 21 allows to preload the spring 20 to a preset value, so that it is not further compressed when the user rotates the quarter counterclockwise and therefore backwards; this allows direct transmission of the forces at the first projection 14 of the block 15.

Therefore, in this condition, the braking elements, and therefore the block or blocks, perform their function at the wheels, braking their motion.

The pre-load value set on the spring 20 is such that the spring is further compressed when the pre-load is exceeded, so that there is ideally no transfer of energy and therefore ideally no transmission of forces beyond a selected value at the first projection 14 of the block 15; during this step, the bar 10 can therefore slide with respect to the projection 14 in contrast with the spring 20.

The braking control device 19 thus allows to adjust the limit of the force applicable to the braking elements beyond which the spring acts: said limit can be set so that the braking elements interact with the wheels in a condition which is close to their locking but does not cause locking, since the spring compresses and further forces are not substantially transmitted if the quarter is tilted further backwards.

Figure 2:
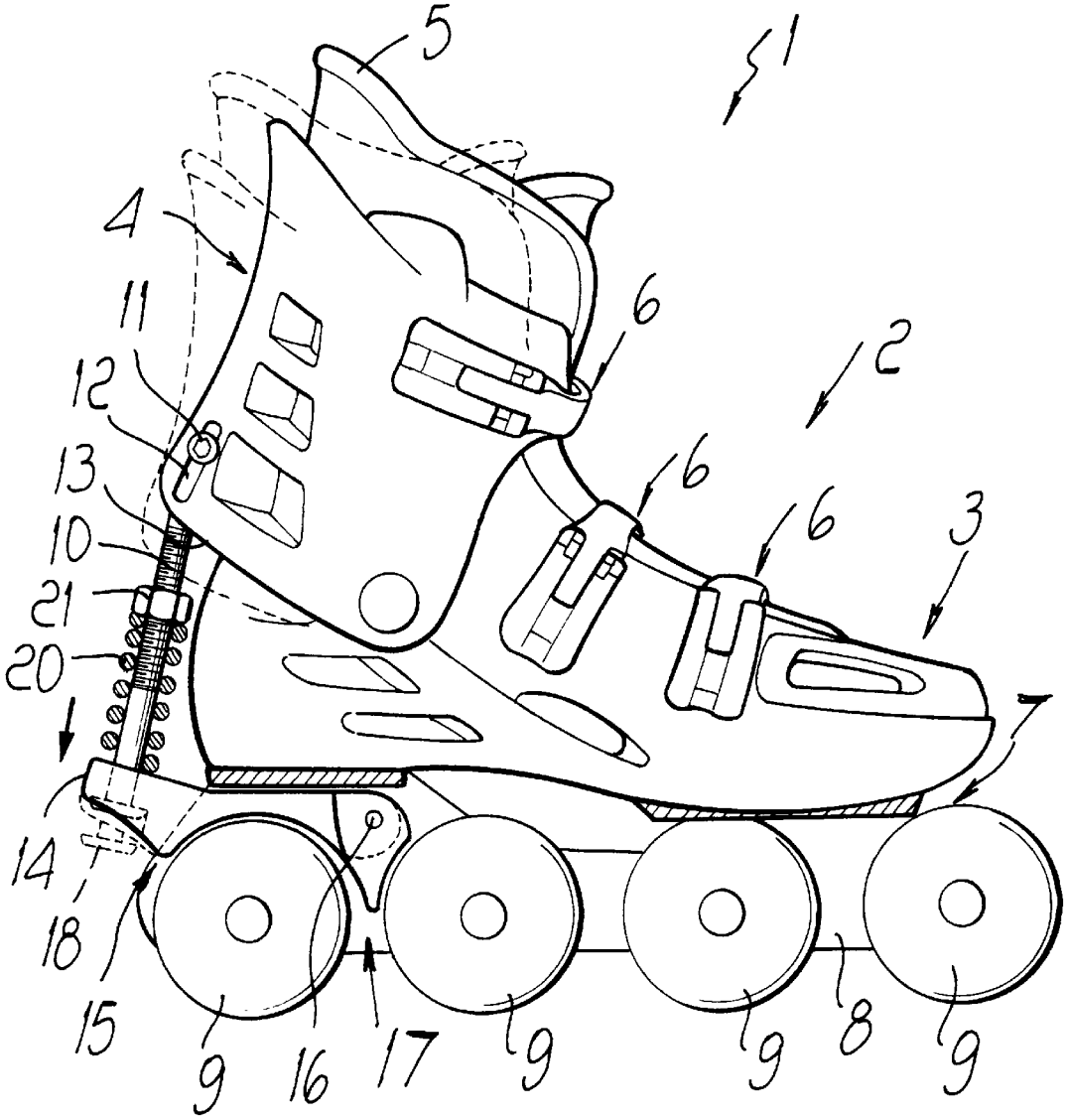
FIG. 2 is a view, similar to FIG. 1, of a second embodiment.

FIG. 2 illustrates a similar embodiment, wherein the second projection 17 of the block 15 is an independent element articulated at the pivot 16.

It has thus been observed that the present invention has achieved the intended aim and objects, a device having been provided which allows to control the braking action so that, regardless of the forces applied by the user, the braking elements do not lock the wheels and therefore allow to maintain, for the wheels, the optimum condition of rolling friction against the ground.

Any "flattening" of the wheels is thus avoided, allowing to achieve more uniform wear thereof caused substantially by rolling on the ground.

It is also possible to vary, depending on specific requirements such as terrain type, user weight and others, the maximum load that the user can apply to the braking elements without locking the wheels; this is done simply by acting at the nut 21 adjusting the pre-loading of the spring 20.

The present invention is of course susceptible of numerous modifications and variations, all of which are within the scope of the same inventive concept.

Figure 3:
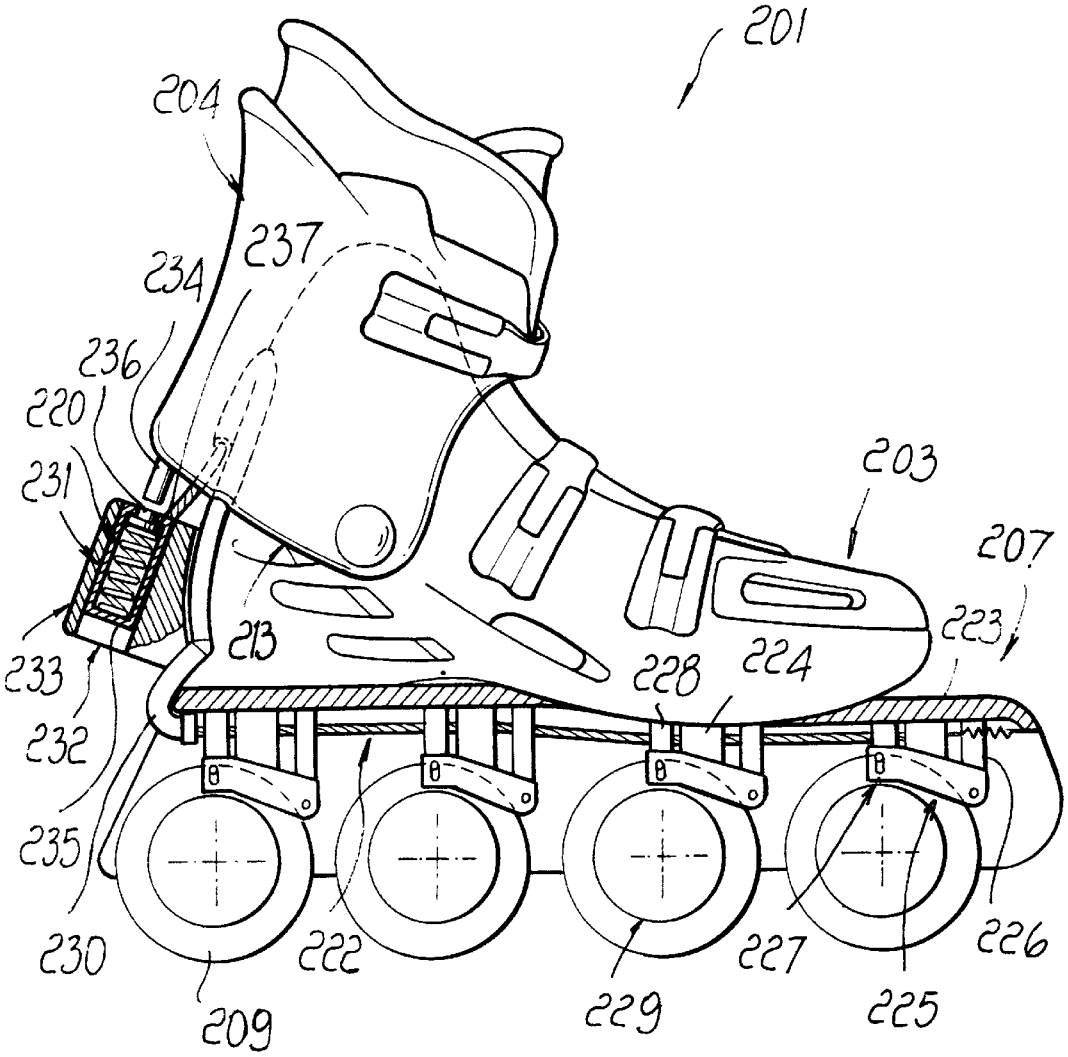
FIG. 3 is a view, similar to FIG. 2, of another embodiment, showing the condition wherein the braking elements are inactive.
Figure 4:
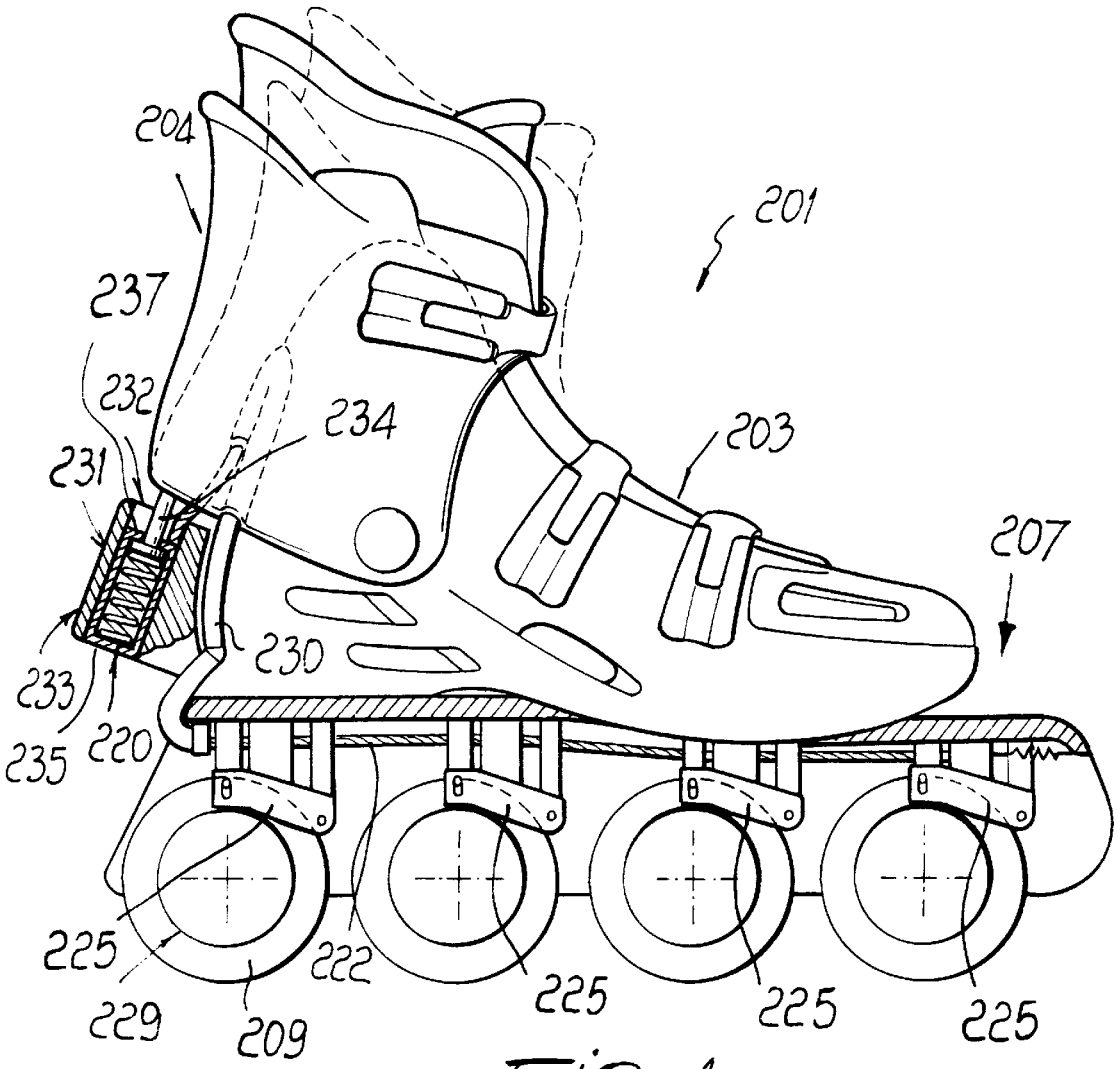
FIG. 4 is a view, similar to FIG. 3, of the condition wherein the braking elements are activated but the braking control device is not.
Figure 5:
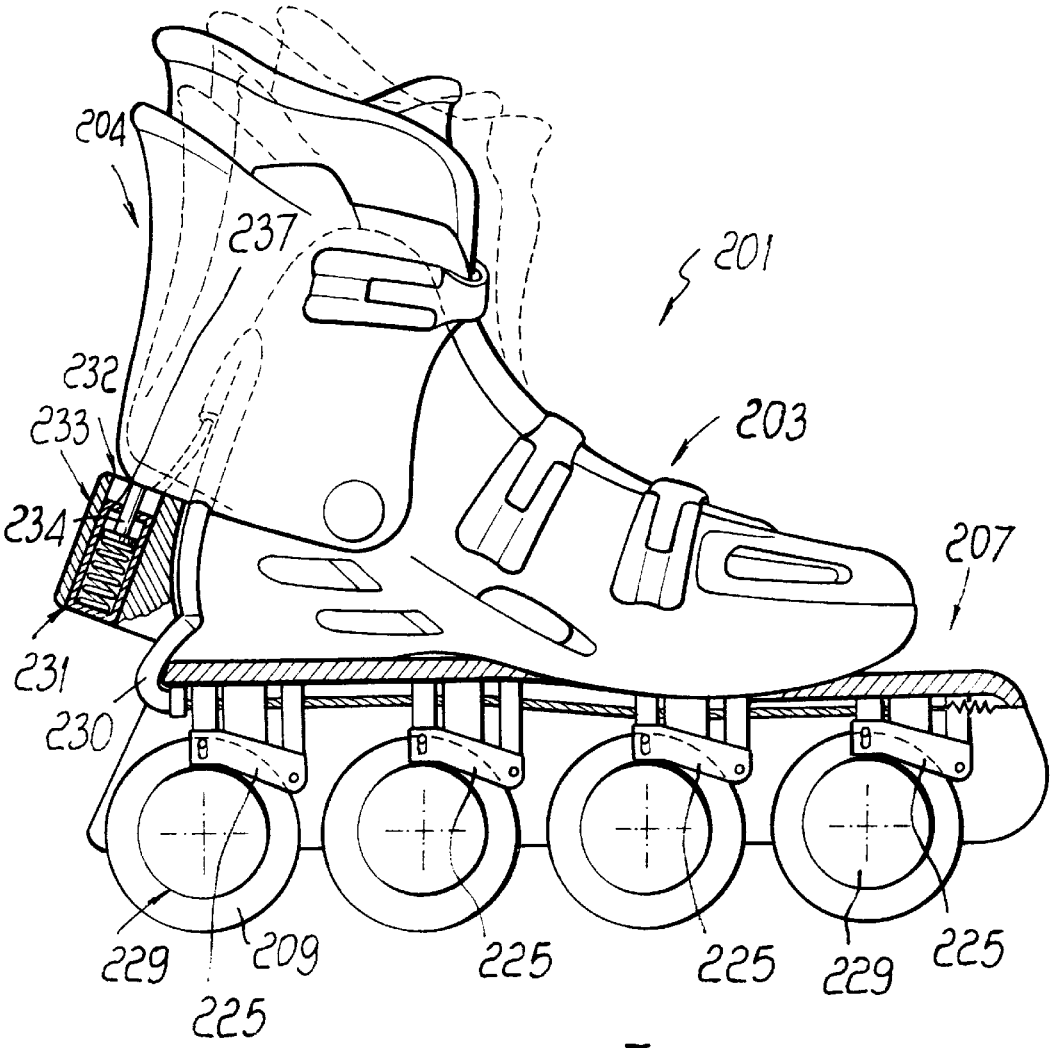
FIG. 5 is a view, similar to FIG. 4, of the condition wherein the braking control device is activated.

Thus, for example, FIGS. 3, 4 and 5 illustrate a skate 201 wherein the braking elements are constituted by a traction element, such as a cable 222, provided with a portion passing below the flat base 223 of the chassis 207 and connected, at one end and approximately at the wheels 209, to trapezoidal elements 224 which can slide in the interspace between the base 223 and the straight profile of a bar 225 which is pivoted to a first rod 226 at one end and can slide, at the other end, in a slot 227 formed in a second rod 228. The first and second rods protrude below the base 223.

The bars 225 interact at an underlying hub 229 which is part of the wheels 209.

Such a device is disclosed in the Italian Patent application No. MI91A002373, in the name of this same Applicant.

Proximate to the rear end of the chassis 207, the cable 222 is slidingly associated at an adapted sheath 230, which is associated at the shell 203 so that it is interposed between said shell and the quarter 204 and can then be curved so that the tip faces the heel region of the user.

The cable 222 is then associated at the upper end of a cylinder 231 which is slidingly associated at a complementarily shaped seat 232 formed at an adapted support 233 and rigidly coupled to, and protruding to the rear of, the shell 203 at the heel region.

A pin 234 protrudes at the lower perimetric edge 213 of the quarter 204 towards the cylinder 231 and in axial alignment therewith; when the skate is at rest, the pin faces the cylinder 231, as shown in FIG. 3.

The cylinder 231 has a closed bottom 235 at one end which is directed towards the ground, and has, on the opposite side, a hole 236 the dimensions whereof are such as to allow the loose insertion of the pin 234 when the quarter is rotated backwards.

A disk 237 is provided inside the cylinder 231, and the end of a flexible element, such as a spring 220, abuts against the disk. The flexible element abuts, at its other end, against the bottom 235 of the cylinder 231.

Accordingly, when the quarter is rotated backwards, the pin 234 enters the hole 236 of the cylinder: as in the previously described case, the spring 220 has such a preloading that it allows the cylinder 231 to slide in the seat 232, at the same time pulling the cable 222, thus activating the braking elements.

The pre-loading of the spring is such that when a preset limit is exceeded, the spring is compressed and the cylinder remains in the same position with respect to the support 233; in this manner, any greater force applied by the user, for example by rotating the quarter 204 further, does not substantially increase the interaction of the braking elements with the hubs of the wheels and therefore unwanted locking of the wheels does not occur.

This device, too, therefore achieves the intended aim and objects, with the further advantage that it has a very limited bulk and therefore substantially improves the style of the skate.

Figure 6:
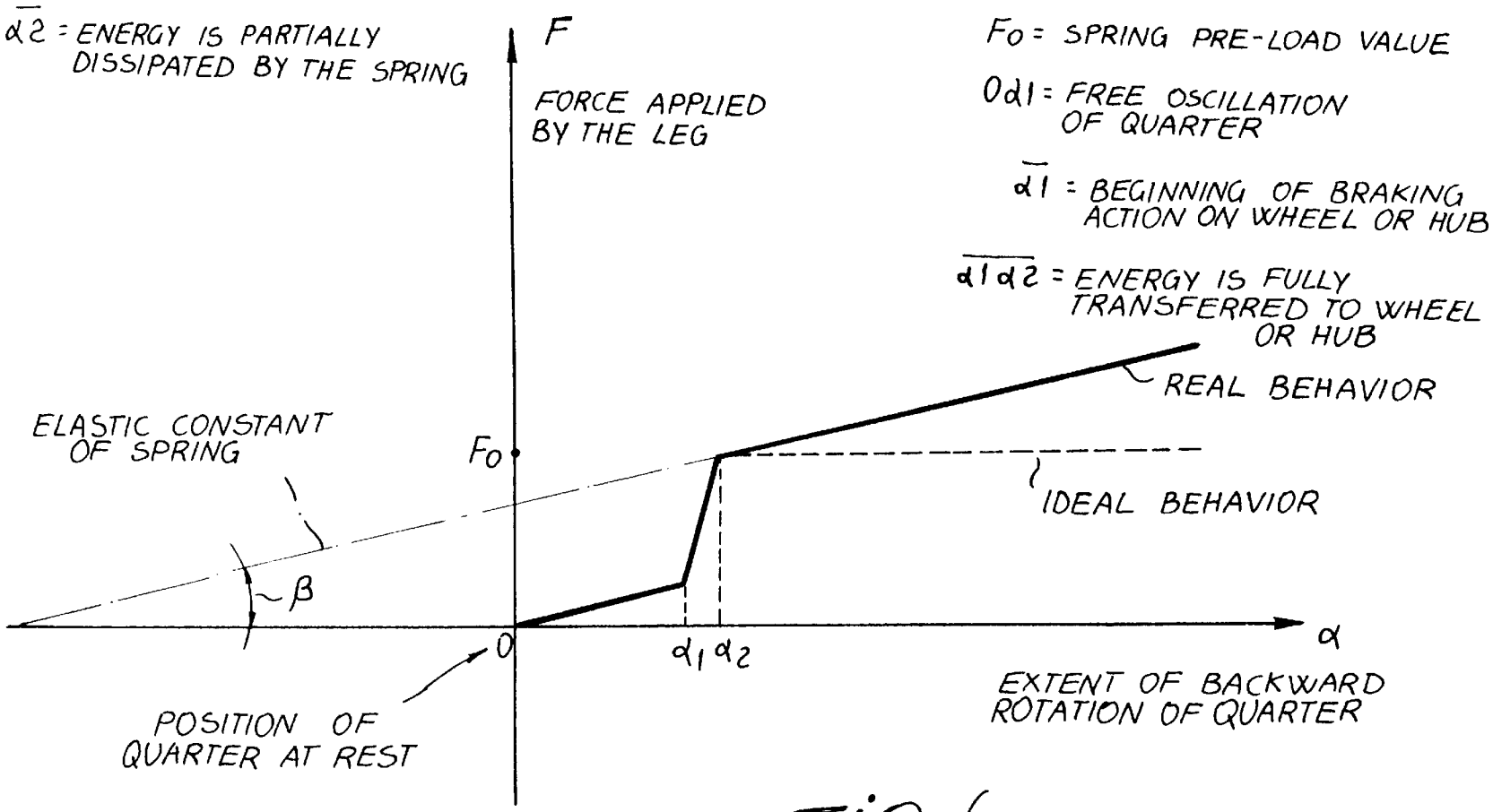
FIG. 6 is a diagram of the relation between the force applied to the hub or wheel and the extent of the backward rotation of the quarter.

FIG. 6 is a diagram wherein the horizontal axis represents the angles of backward rotation of the quarter and the vertical axis represents the force applied by the leg.

The diagram shows that if the value of the pre-loading of the spring is determined and designated by $F_0$,a rotation of the quarter up to an angle $\alpha_1$ produces the free travel of the quarter, whilst in the subsequent segment $\alpha_1$–$\alpha_2$ all the energy is transferred to the braking elements and the spring does not intervene during this step.

When the rotation is greater than $\alpha_2$, the excess energy will be absorbed by the spring, assuming the system as isolated and therefore with no friction and complete transmission of the forces; therefore, there will be no additional force applied to the wheel or to the hub.

In the real case where a spring has a minimum value of the elastic constant equal to an angle $\beta$, in the diagram of FIG. 6, the transmitted force will not be constant, but rather slightly increasing according to the same angle $\beta$, which besides is rather small and therefore negligible. Such force will therefore increase only very little and in any case will not cause the wheels to lock since it is sufficient to vary the setting of $F_O$.

Figure 7:
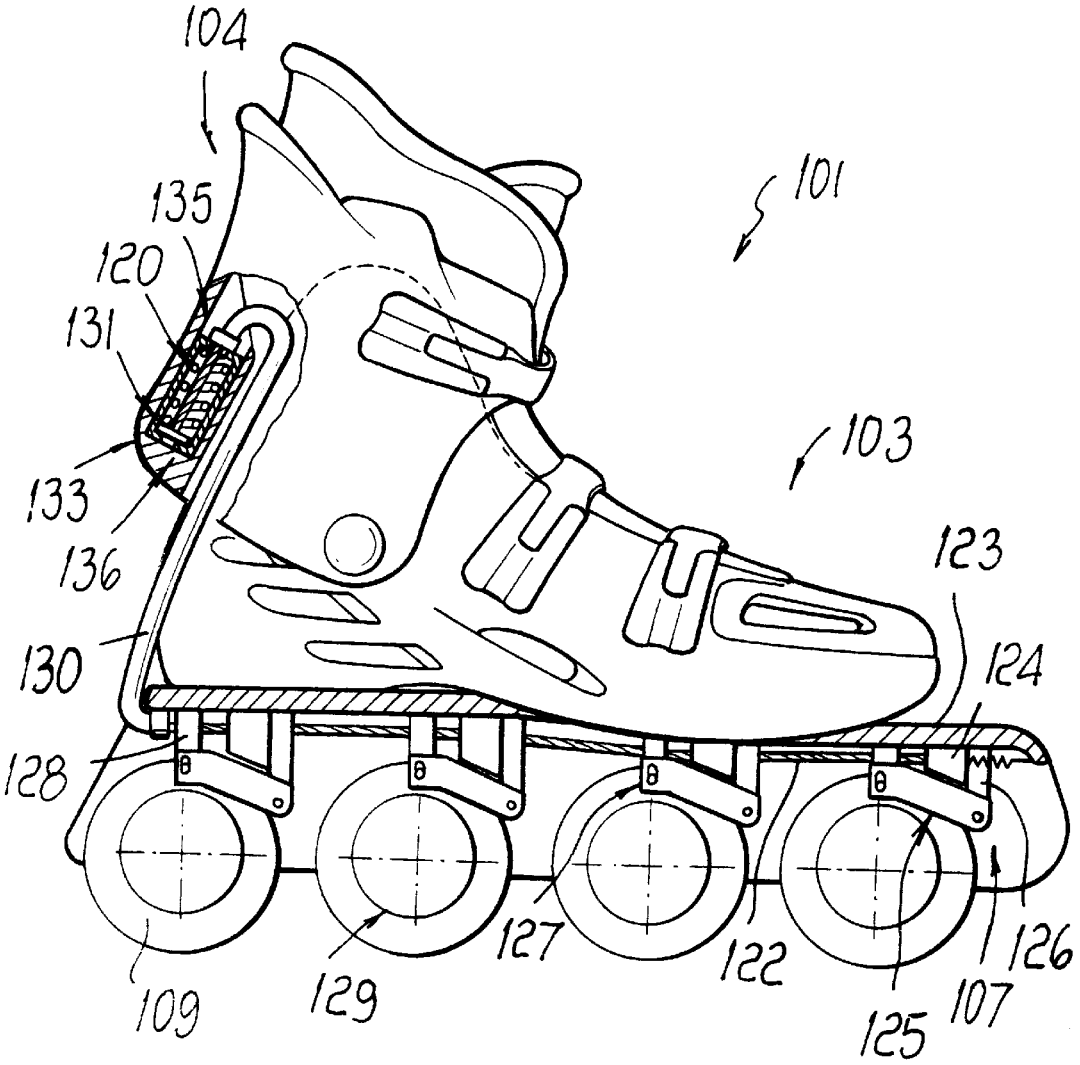
FIG. 7 is a view, similar to FIG. 3, of another embodiment.
Figure 8:
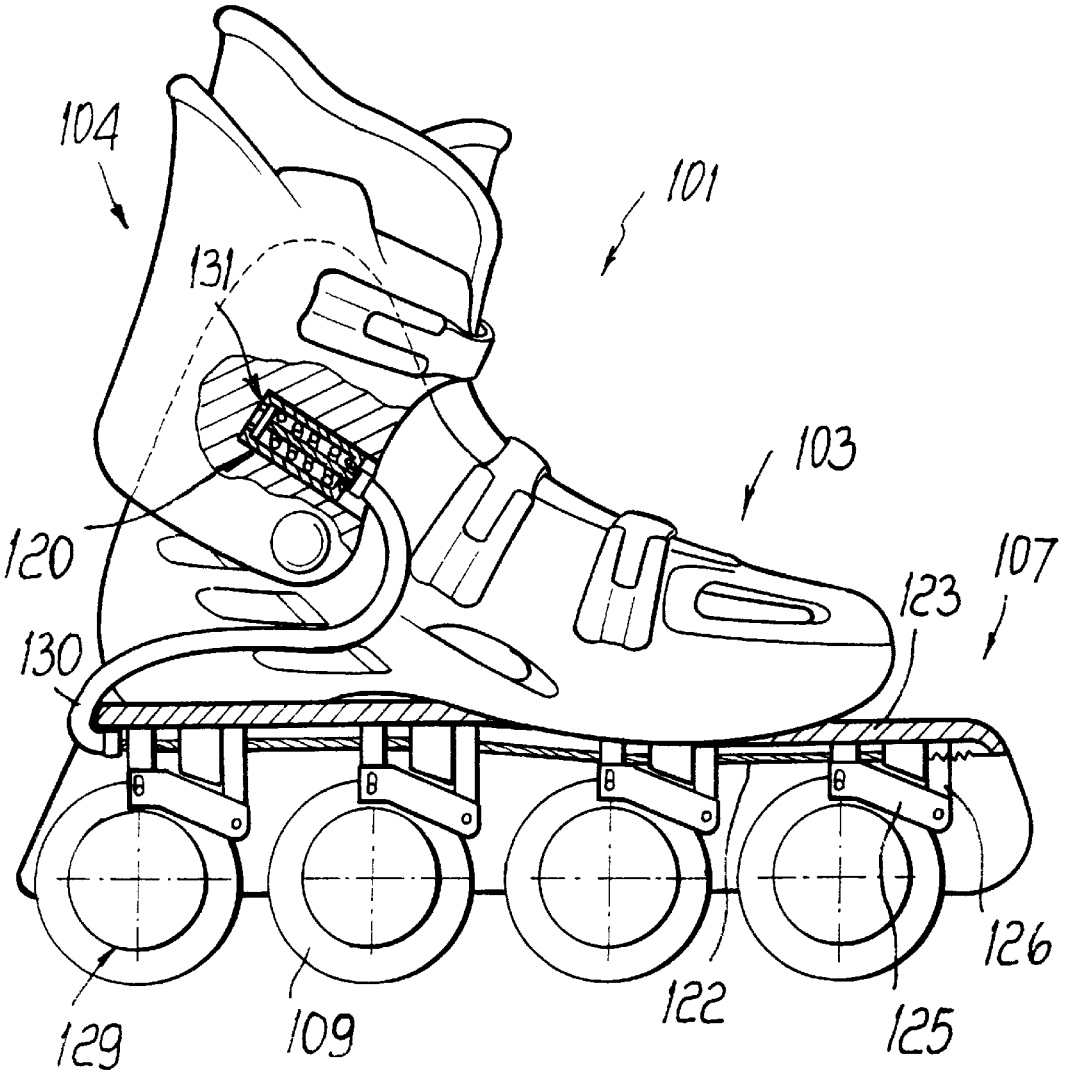
FIG. 8 is a view, similar to FIG. 7, of another embodiment in the condition wherein the braking elements are not activated.
Figure 9:
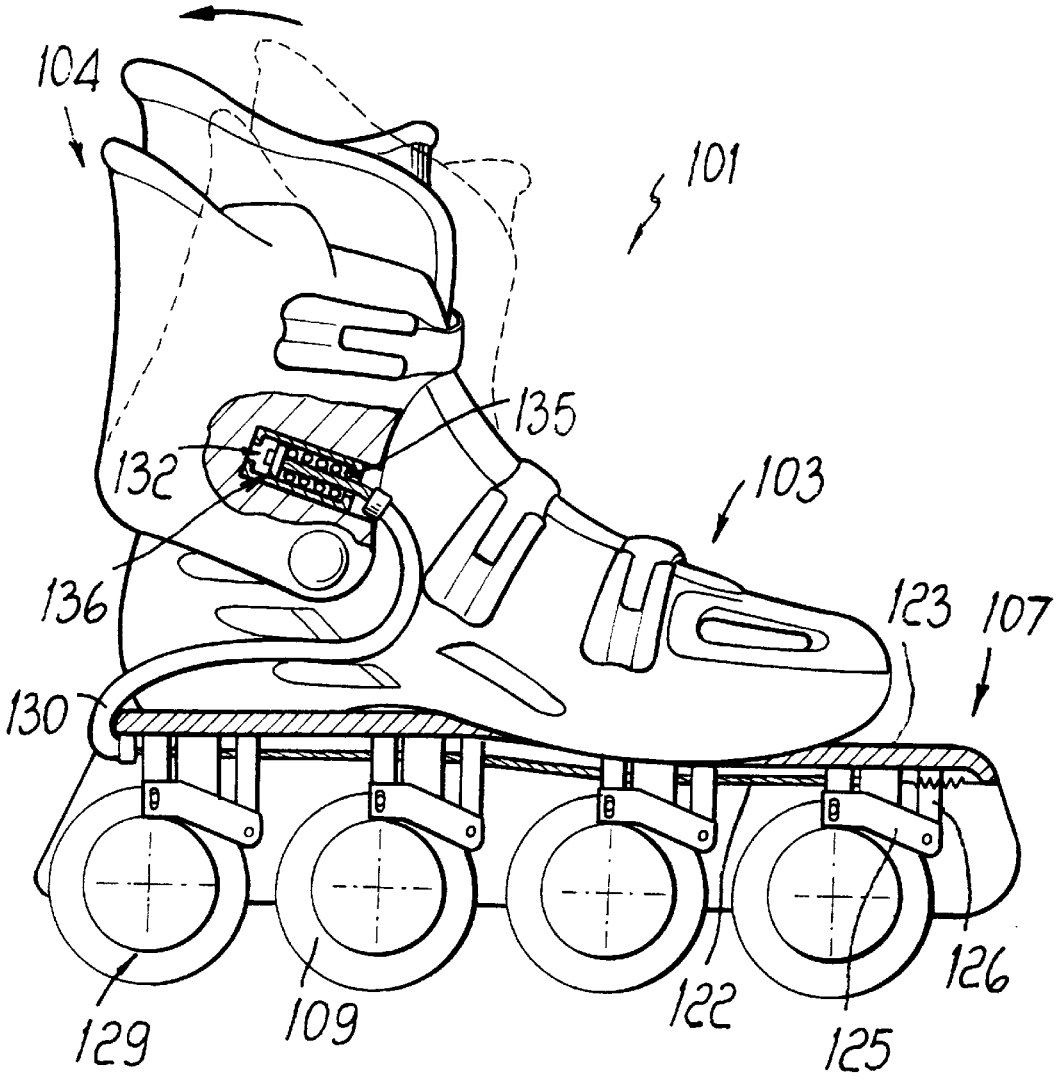
FIG. 9 is a view, similar to FIG. 8, of the skate in the condition wherein the quarter is moved back.

FIGS. 7, 8 and 9 illustrate a skate 101 wherein the braking elements are again constituted by a cable 122 provided with a portion passing below the flat base 123 of the chassis 107 and connected, at one end and approximately at the wheels 109, to trapezoidal elements 124 which can slide in the interspace between the base 123 and the straight profile of a bar 125 which is pivoted to a first rod 126 at one end and can slide, at the other end, in a slot 127 formed in a second rod 128, the first and second rods protruding below the base 123.

The bars 125 interact at an underlying hub 129 belonging to the wheels 109.

Proximate to the rear end of the chassis 107, the cable 109 is slidingly associated at an adapted sheath 130, which is associated at the shell 103 so as to be interposed between said shell and the quarter 104 and is then curved so that the tip faces the region of the user's heel, as shown in FIG. 7, or is arranged laterally to the quarter, as shown in FIGS. 8 and 9.

The cable 122 is also associated at the lower end of a cylinder 131 which is slidingly associated at a complementarily shaped seat 132 formed at an adapted support 133 provided at the rear or lateral region of the quarter.

The cylinder 131 has, at one end which is directed away from the ground or towards the chassis, a perforated bottom 135 allowing the cable 122 to pass; the cable is associated, at one end, inside the cylinder, with a disk 136 slideable within said cylinder.

Coaxially to the cable 122 there is provided a flexible element, such as a spring 120, which abuts against the bottom 135 and the disk 136.

When the quarter is rotated backwards, the cable is activated and therefore the braking element is also activated: as in the previously described case, the spring 120 has such a pre-loading that it subjects the cable to traction until the applied force is higher than a preset pre-loading value, beyond which said spring compresses, substantially preventing the transfer of the additional force to the braking element.

These devices, too, therefore achieve the intended aim and objects.

FIGS. 10*a* and 10*b* illustrate the two ideal behavior diagrams, wherein the horizontal axis represents the values of the force $F_G$ applied to the quarter and the vertical axis represents respectively the force $F_R$ applied to the wheel and the force $F_M$ absorbed by the spring.

The materials and the dimensions constituting the individual components of the invention may of course be the most pertinent according to specific requirements.

What is claimed is:

1. A braking control device, particularly for skates comprising a shoe having a toe portion at a forward location and a heel portion at a rearward location, also having a pivoting quarter, the shoe being connected with a chassis having a plurality of wheels, at least one of said wheels interacting with brake means, the braking control device comprising means allowing to transfer a braking force to said at least one wheel up to a presettable value, which is preferably close to the value required to lock said at least one wheel and beyond which an excess force is substantially not transferred to said at least one wheel, said brake means comprising:

a braking block pivoted to said chassis; and a bar connected at a first end to said quarter and slidingly engaged in a seat of a rearward protrusion of said braking block, said bar comprising at a second end thereof a T-shaped tip forming a head abutting against said protrusion of said braking block.

2. A device according to claim 1, wherein said bar is connected, at said first end, by means of an adapted screw, at slots formed approximately longitudinally with respect to said quarter proximate to a lower perimetric edge of said quarter, in a region lying approximately above a user's heel, and wherein said bar is at least partially threaded and wherein at least one complementarily threaded nut is rotatably connected therewith.

3. A device according to claim 2, wherein said block is arranged between a pair of wings of said chassis and is positioned above a last rearward wheel of said plurality of wheels, and said block being pivoted at one end of said block distal from said rearward protrusion of said block, by means of a pivot, between said wings, said head of said bar abutting against said protrusion of said block when said quarter is rotated forwardly.

4. A device according to claim 3, wherein said brake means further comprises a spring arranged coaxially to said bar and interposed between said protrusion of said block and said at least one nut.

5. A device according to claim 4, wherein said at least one nut compresses said spring to a preset value, so that said spring does not further compress when said quarter is rotated rearwardly because the force on the spring does not exceed the preset value of the spring, so forces are transmitted directly from said quarter to said protrusion of said block.

6. A device according to claim 5, wherein when said quarter is further rearwardly rotated and the force on the spring exceeds the preset value of the spring, said spring is compressed, so that no further forces are substantially transmitted from said quarter to said protrusion of said block.

7. A brake device in a roller skate having a shoe and a quarter pivoted to the shoe and wheels rotatably supported below the shoe, the brake device comprising:

a braking element operably movable by a pivoting movement of said quarter between a braking position, in which the quarter is positioned with respect to the shoe in at least one braking position and the braking element is in an engagement position with at least one of said wheels of the roller skate for braking said at least one of said wheels, and a non-braking position, in which the quarter is positioned with respect to the shoe in at least one non-braking position and the braking element is in a non-engagement position with respect to said wheels;

an elastic spring element compressed to a selectable pre-load and interconnected between the quarter and the braking element such that a pivoting movement of the quarter from said at least one non-braking position into said at least one braking position causes said braking element to move from said non-engagement position with respect to said wheels into said engagement position with said at least one of said wheels and said elastic spring element is not further elastically compressed beyond its pre-load while the load to which said elastic spring element is subjected does not exceed said selectable load limit until the load to which said elastic spring element is subjected exceeds said selectable load limit whereupon said elastic spring element compresses elastically for substantially avoiding an increased braking action on said at least one of said wheels for avoiding locking of said at least one of said wheels;

said braking element being an articulated braking element pivotably movable about a pivot axis between said non-engagement position with respect to said wheels and said engagement position with at least one of said wheels; and said brake device further comprising a rod interconnected between said quarter and said braking element, said rod being slidably engaged in a hole of said braking element, said elastic spring element being arranged about said rod.

* * * * *